US009884240B2

(12) United States Patent
Gudalis

(10) Patent No.: US 9,884,240 B2
(45) Date of Patent: Feb. 6, 2018

(54) THREE DIMENSIONAL KNEE AND ELBOW PADS

(71) Applicant: 3DCALZ, LLC, Lexington, KY (US)

(72) Inventor: Brian M. Gudalis, Lexington, KY (US)

(73) Assignee: 3DCALZ, LLC, Lexington, KY (US)

( * ) Notice: Subject to any disclaimer, the term of this patent is extended or adjusted under 35 U.S.C. 154(b) by 443 days.

(21) Appl. No.: 14/207,981

(22) Filed: Mar. 13, 2014

(65) Prior Publication Data

US 2014/0189926 A1 Jul. 10, 2014

Related U.S. Application Data

(63) Continuation-in-part of application No. 14/050,439, filed on Oct. 10, 2013, now abandoned.

(60) Provisional application No. 61/798,583, filed on Mar. 15, 2013, provisional application No. 61/723,177, filed on Nov. 6, 2012, provisional application No. 61/755,208, filed on Jan. 22, 2013.

(51) Int. Cl.

| | |
|---|---|
| ***A41D 13/015*** | (2006.01) |
| ***A63B 71/12*** | (2006.01) |
| ***A41D 13/06*** | (2006.01) |
| ***A41D 13/08*** | (2006.01) |

(52) U.S. Cl.

CPC ..... *A63B 71/1225* (2013.01); *A41D 13/0156* (2013.01); *A41D 13/065* (2013.01); *A41D 13/08* (2013.01)

(58) Field of Classification Search

CPC ..... A41D 13/0543; A41D 13/065; A41D 13/0015; A41D 13/015; A41D 13/05; A41D 13/0156; A41D 13/0568; A41D 13/0587; A41D 13/0153; A41D 13/0512; A41D 13/06; A41D 13/00; A41D 13/0005; A41D 13/001; A41D 13/0051; A41D 13/0506; F16B 2/22; F16B 21/075; F16B 5/065; F16B 5/0657; F16B 21/086; F16B 2/12; F16B 2/24; F16B 45/00; F16B 5/0614; F16B 5/0635; F16B 5/0664; F16B 5/123; A63B 71/1225

USPC ..... 2/22, 23, 2, 267, 16

See application file for complete search history.

(56) References Cited

U.S. PATENT DOCUMENTS

| | | | |
|---|---|---|---|
| 2,544,065 | A | 3/1951 | Carr |
| 2,629,094 | A | 2/1953 | Goldsmith |
| 2,717,387 | A | 9/1955 | Mcmahan |
| 4,455,686 | A | 6/1984 | Zide |

(Continued)

FOREIGN PATENT DOCUMENTS

| | | |
|---|---|---|
| WO | WO 01/87432 | 11/2001 |

OTHER PUBLICATIONS

"Reebok HP5K Breezers"; Play It Again Sports, Jan. 29, 2013; web search, one page.

(Continued)

*Primary Examiner* — Alissa L Hoey
*Assistant Examiner* — Catherine M Ferreira
(74) *Attorney, Agent, or Firm* — Knobbe Martens Olson & Bear LLP

(57) ABSTRACT

A sports pad is provided including an outer shell defining a pocket and a pad received and held in the pocket. A three dimensional image element is captured between said outer shell and the front face of the pad. That image element projects an image outline through the outer shell to enhance the uniform of the player wearing the sports pad.

20 Claims, 6 Drawing Sheets

(56) References Cited

U.S. PATENT DOCUMENTS

| | | | | |
|---|---|---|---|---|
| 4,479,269 | A | 10/1984 | Balliet | |
| 4,591,521 | A | 5/1986 | Freno et al. | |
| 5,079,778 | A * | 1/1992 | Sloot | A41D 27/08 2/115 |
| 5,334,135 | A | 8/1994 | Grim | |
| 5,423,087 | A * | 6/1995 | Krent | A41D 13/0156 2/267 |
| 5,671,478 | A | 9/1997 | Yen | |
| 5,742,938 | A | 4/1998 | Winningham | |
| 5,933,866 | A * | 8/1999 | Fox | A41D 27/08 2/115 |
| 5,978,962 | A * | 11/1999 | Hamowy | A41D 13/0568 2/16 |
| 6,000,147 | A * | 12/1999 | Kellerman | A43B 7/142 36/160 |
| 6,014,771 | A | 1/2000 | Kirven | |
| RE37,533 | E * | 1/2002 | Beige | A41D 1/00 264/257 |
| 6,443,081 | B1 | 9/2002 | Quint | |
| 6,532,599 | B1 | 3/2003 | Dugan | |
| 7,003,803 | B1 | 2/2006 | Lyden | |
| 7,517,331 | B2 | 4/2009 | Reinhardt | |
| D656,278 | S * | 3/2012 | Saranga | D29/121.1 |
| D684,323 | S | 6/2013 | Macrina et al. | |
| 2006/0156456 | A1 | 7/2006 | Teixeira | |
| 2006/0179538 | A1 | 8/2006 | Dodd | |
| 2008/0113143 | A1* | 5/2008 | Taylor | A41D 31/005 428/47 |
| 2010/0024089 | A1* | 2/2010 | Turner | A41D 13/05 2/23 |
| 2010/0192269 | A1 | 8/2010 | Saranga | |
| 2011/0056004 | A1 | 3/2011 | Landi | |
| 2011/0277226 | A1 | 11/2011 | Turner | |
| 2011/0307998 | A1* | 12/2011 | Turner | A41D 13/0562 2/455 |
| 2012/0297525 | A1 | 11/2012 | Bain | |

OTHER PUBLICATIONS

International Search Report and Written Opinion for International Application No. PCT/US2013/068440 dated May 1, 2014.

International Preliminary Report on Patentability dated May 12, 2015 in PCT/US2013/068440.

Extended European Search Report dated Oct. 16, 2016 in patent application No. 13853756.8.

* cited by examiner

THREE DIMENSIONAL KNEE AND ELBOW PADS

This utility patent application claims the benefit of priority in U.S. Provisional Patent Application Ser. No. 61/798,583, filed on Mar. 15, 2013 and is a continuation-in-part of U.S. patent application Ser. No. 14/050,439, filed on Oct. 10, 2013, which claims the benefit of priority in U.S. Provisional Patent Application Ser. No. 61/723,177, filed on Nov. 6, 2012 and U.S. Provisional Patent Application Ser. No. 61/755,208, filed on Jan. 22, 2013, the entirety of the disclosures of which are incorporated herein by reference.

TECHNICAL FIELD

This document relates generally to the sports equipment field and, more particularly, to elbow and knee pads including a three dimensional image element for projecting a desired image outline.

BACKGROUND OF THE INVENTION

Sports enthusiasts including, for example, volleyball players, commonly wear padding on their elbows and knees in order to protect their elbows and knees from contact with hard surfaces such as a gym floor. This document relates to sports pads for knees and elbows that incorporate a three dimensional image element which projects an image outline of a desired shape such as a player number or team logo that enhances the team uniform.

SUMMARY

A sports pad comprises an outer shell defining a pocket and a pad received and held in the pocket. The pad has a front face. A three dimensional image element is carried on the front face of the pad. That image element projects an image outline through the outer shell.

That image outline may take on any desired shape. In one possible embodiment the image element is in the shape of a player number. In another possible embodiment the image element is in the shape of a logo.

In one possible embodiment the three dimensional image element is provided on a background sheet. In one possible embodiment the three dimensional image element is tapered outwardly from a central area toward an outer edge so that the central area projects a greater distance from the front face of the pad than does the outer edge.

In accordance with another aspect, the pad further includes a fastener for securing the pad to a limb of an individual wearing the pad. In one possible embodiment the fastener is a partial or full elastic sleeve. In another possible embodiment the fastener includes at least one elongated strap and a cooperating hook and loop fastening device. In one possible embodiment the pad is configured to protect and be worn over a knee. In another possible embodiment the pad is configured to protect and be worn over an elbow.

In one possible embodiment the outer shell is a first color and the three dimensional image element is a second color. In one possible embodiment the first and second colors contrast. In another possible embodiment the three dimensional image element is provided on a background sheet and the three dimensional image element is a first color, the background sheet is a second color and the outer shell is a third color. In one possible embodiment the first, second and third colors are all different. In another possible embodiment the second and third colors are the same and the first color is different. In another possible embodiment the first and third colors are the same and the second color is different.

In yet another possible embodiment the three dimensional image element and the front face are different colors. In yet another possible embodiment the three dimensional image element and the front face are the same color.

In accordance with an additional aspect a method of promoting a sports team is provided. That method comprises equipping a player on the sports team with a sports pad including a three dimensional image element that projects an image outline of a logo. In one embodiment that method further includes wearing the pad on a knee. In another embodiment that method further includes wearing the pad on an elbow.

These and other embodiments will be set forth in the description which follows and in part will become apparent to those of ordinary skill in the art by reference to the following description and drawing figures.

BRIEF DESCRIPTION OF THE DRAWINGS

The accompanying drawings incorporated herein and forming a part of the specification, illustrate several aspects of the sports pad and together with the description serve to explain certain principles thereof. In the drawings.

Figure 1:
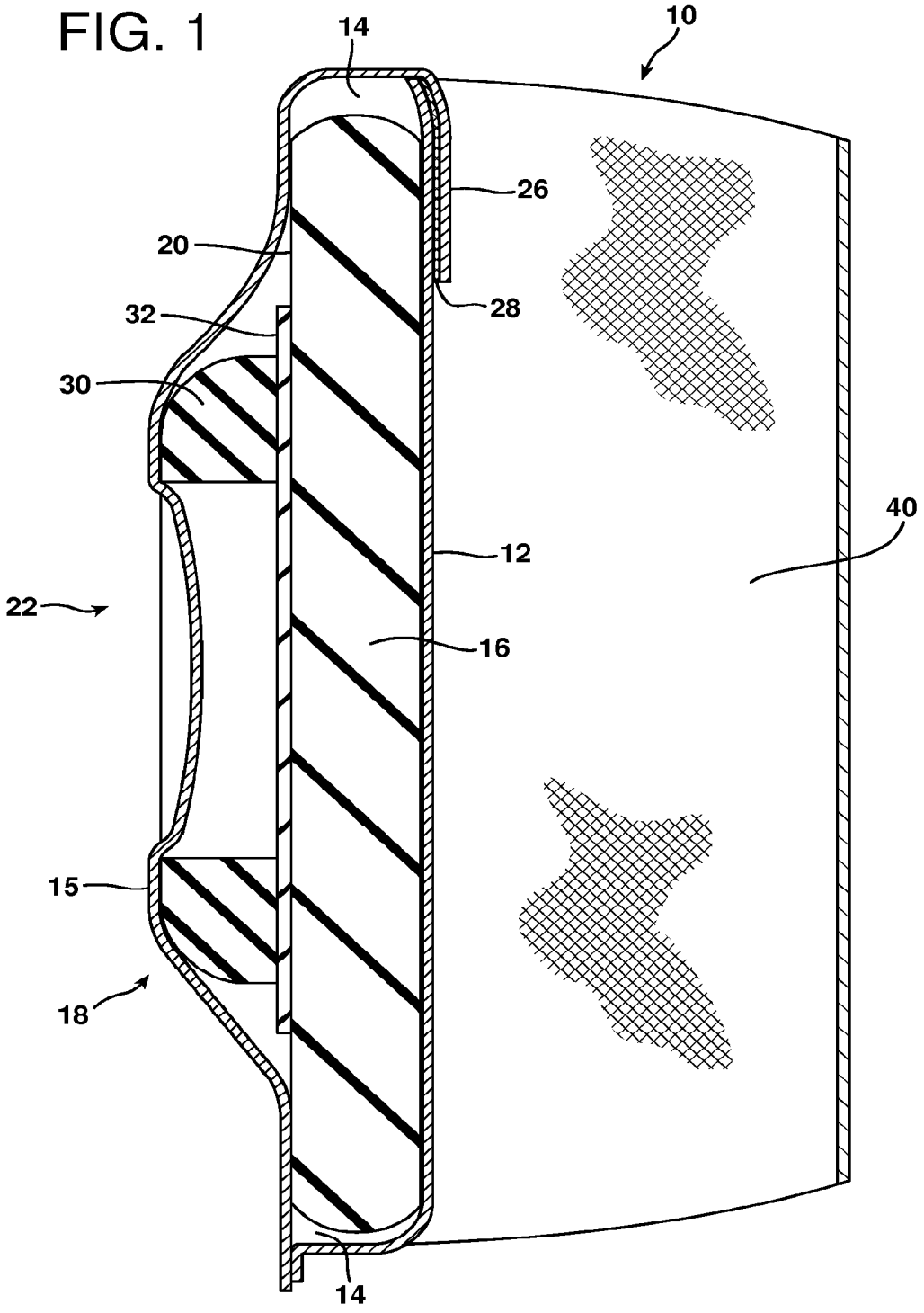
FIG. 1 is a cross-sectional view of a sports pad including an outer shell defining a pocket, a pad received and held in the pocket and a three dimensional image element carried on the front face of the pad so that the image element projects an image outline through the outer shell.

Reference will now be made in detail to the present preferred embodiments, examples of which are illustrated in the accompanying drawings.

DETAILED DESCRIPTION

Reference is now made to FIGS. 1-4 illustrating a sports pad 10 including an outer shell 12 that defines a pocket 14 for receiving and holding a pad 16. A three dimensional image element 18 is captured between the pad 16 and the part of the shell 12 forming the pocket 14. In the illustrated embodiment the image element 18 is carried on the front face 20 of the pad 16.

As should be appreciated, the three dimensional image element 18 projects an image outline 22 through the outer shell 12 which is made from a fabric material commonly employed in the construction of knee and elbow pads. More specifically, the portion 15 of the outer shell 12 overlying and engaging the image element 18 conforms to the shape of the image element. That image outline 22 may take the shape and form of any desirable image including, but not limited to, a player number and a logo. For purposes of this document, the term "logo" refers to letters, words, numbers, names, trademarks, mascots, images, stripes, designs and other three dimensional shapes that may commonly identify or be used by athletic teams, athletes and individuals.

In one possible embodiment illustrated in FIG. 1, the pocket 14 may be opened or closed by means of a flap 26. When the flap 26 is open, the pad 16 may be removed from the pocket 14 for cleaning or to change or reposition the element 18 on the front face 20 of the pad 16. The pad 16, with the three dimensional element 18 in its proper position, may then be replaced in the pocket 14. The flap 26 is then folded over the top of the pad 16 and secured by hook and loop fastener 28 or other similar means to the outer shell 12 at the rear of the pad thereby closing the pocket 14 and securing the pad in position. It should be noted that the illustrated flap 26 is only one possible way of opening and closing a pocket 14 to hold the pad 16 and that the general concept of a sealable pocket is not to be considered as limited thereto.

Figure 2:
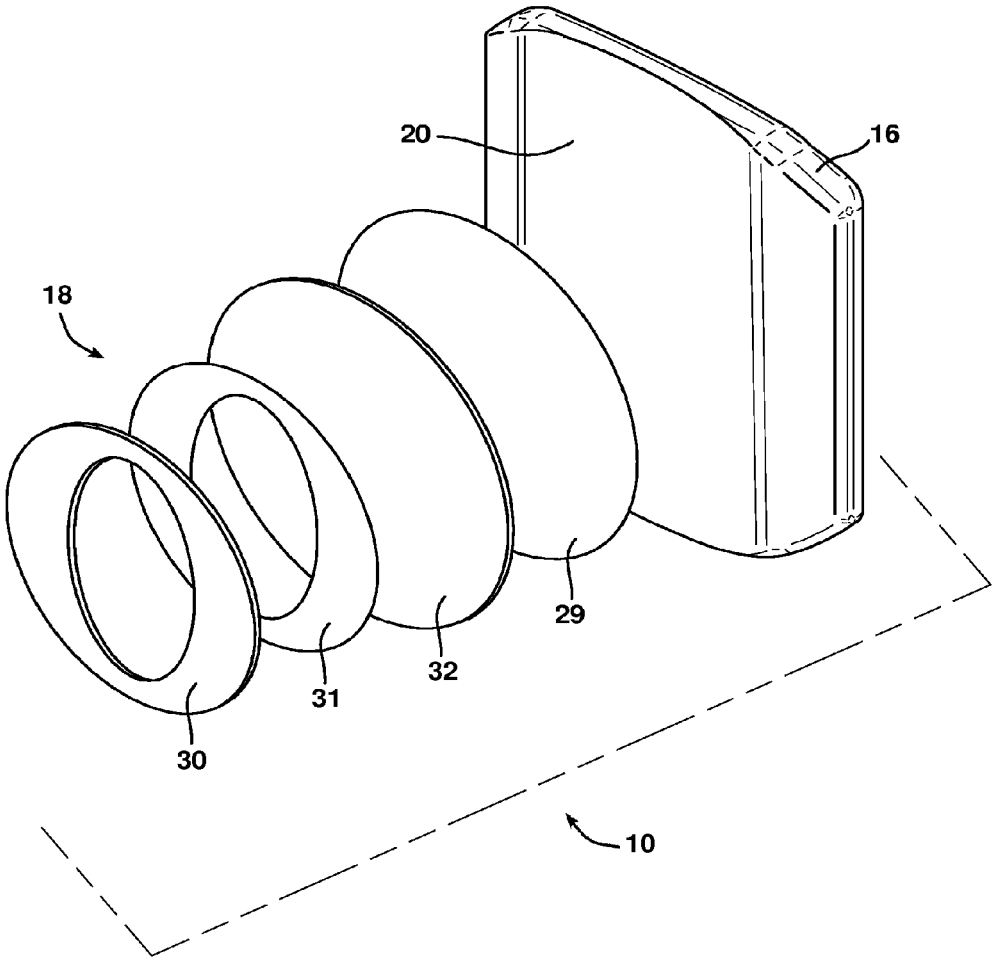
FIG. 2 is an exploded perspective view of the three dimensional image element on the pad.
Figure 3:
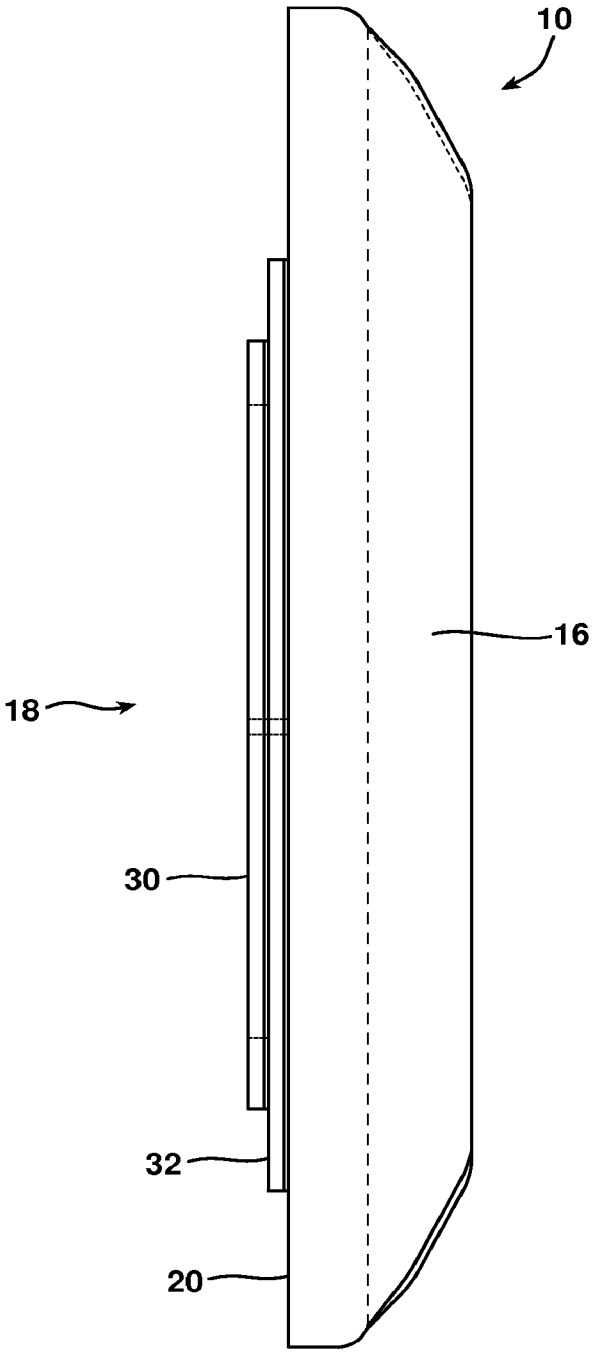
FIG. 3 is a side elevational view of the three dimensional image element connected to the pad.
Figure 4:
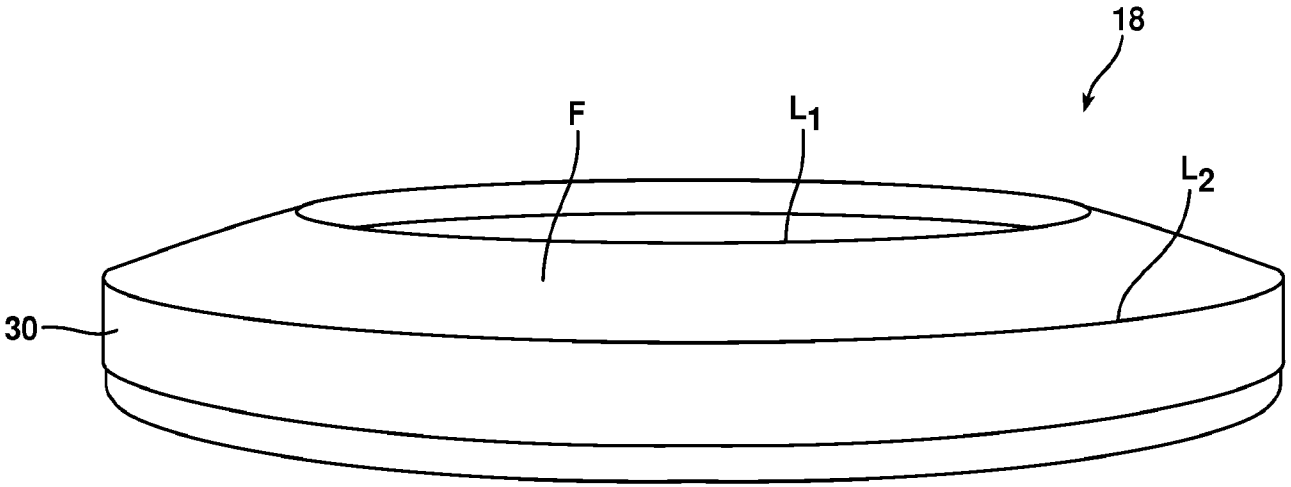
FIG. 4 is a perspective view illustrating the tapering of the three dimensional element from an area of greatest height or width at a central portion thereof to an area of lowest height or width at an outer edge thereof.

As best illustrated in FIGS. 2 and 3, the three dimensional image element 18 is secured to the front face 20 of the pad 16 by means of a fastener 29, such as a layer of adhesive or a hook and loop fastener system such as sold under the trademark VELCRO. The image 18 may include a three dimensional logo 30 alone or a combination of a logo 30 and background sheet 32 (note additional fastener 31) as illustrated that is mounted directly to the front face 20 of the pad 16. FIG. 3 illustrates a combined logo 30 and background sheet 32 secured in position on the front face 20 of a pad 16.

The three dimensional image element 18 may be solid, hollow, an outline or a combination. For example, to form a "shamrock" logo the shape of the shamrock may be cut out of a 3 mm thick piece of foam. The cutout shamrock could be pulled from the foam and adhered to the pad 16. The resulting image outline 22 would appear as a solid shamrock. In addition, the outline of the shamrock that remains in the foam can then be used to show the image outline 22 of a shamrock but instead of it being full, it is an outline of a shamrock or a hollow three dimensional image. Obviously different widths and colors of foam may be utilized to create varying images, shadows and appearances including complex images such as an American flag.

For some images the logo 30 of the three dimensional image element 18 is the same thickness throughout. However, the depth of the logo 30 may be manipulated to give the image outline 22 more or less detail and definition when it projects through the exposed fabric area of the outer shell 12. For example, while a three dimensional image element 18 of a "O" can be seen as a "O" if the entire "O" is 3 mm thick, forming the inside line $L_1$ of the "O" slightly higher than the outside line $L_2$ to create a sloped face F allows the inner circle of the "O" to show differently and this can give it a different detail when it is seen through the clothing or outer shell covering 12 (See FIG. 4). Further there are various ways to manipulate an "O" to make it appear differently while ensuring that it is an "O". For example it can be made a perfect circle or an oval. It can be made flat versus wavy. It can be made using only the outlines of the inside and outside circles. For some images, but not all, the inside lines must be made slightly higher than those on the outside in order for the details to show through the outer shell 12. Also using rounded edges can help give definition. For example an American flag can be made by rounding the red strips of the flag, omitting the white stripes, making the blue a rectangle with square edges and adding slightly raised dots for the stars. This is an example of how different processes and shaping can be used to form a three dimension image element 18 that provides the desired image outline 22 projecting through the exposed fabric area of the outer shell 12.

The three dimensional image element 18 may be made from a number of different materials including, but not limited to foams, high density synthetic materials, foam rubbers and plastics. Particularly useful foam materials include polyethylene foam, polypropylene foam and PVC foam. Regardless of the chemical makeup it is preferred that the foam be a "closed cell" foam. In many instances the three dimensional image element 18 is made from the same material as the pad 10 to which it is attached so that it may be used in athletic events without increasing any risk in injury. In fact, the image element 18 may even be molded into the pad 16.

As should be appreciated the three dimensional image element 18 may be punched or cut from a sheet of foam as previously described. Alternatively, the three dimensional image element 18 may be molded in a mold. The production operation utilized depends on the material being formed into an image and the intended use of the image. Logos 30, like college logos, mascots or trademarks could be punched or cutout from the foam. Logos 30 such as single or entwined letters like an "S", "OU", "NC", "ND", "UK", "3C", etc. show through and produce the desired image 22 whether they are solid letters, outlined letters or a combination of both. Logo images 22 such as an eagle and cat's paw may also be easily produced.

Images or logos 30 formed in molds may be given additional detail in certain areas that is not possible with a simple punching operation. For example, molds may help when forming rounded portions, edges and crevices. This allows the three dimensional image element 18 to produce an image outline 22 that is often times significantly more detailed in appearance from a simple punched image. Forming the image in a mold may help give varying depths within the same image so as to make it look more realistic and provide a desired hologram-like affect to the image outline 22.

It should also be appreciated that the three dimensional image element 18 may be made in multiple sizes to fit different sized items. For example, a three dimensional image element 18 of an eagle could be 12.7 cm wide to fit across a knee pad or 10.0 cm wide to fit on a smaller elbow pad. Obviously, they can also be made of different colors depending on the desired effect. Only a portion of the entire three dimensional image element 18 may include one or more colors to enhance the image as it projects or appears through the exposed fabric area of the outer shell 12 overlying the image element.

Color may be used to enhance the three dimensional effect and the produced image outline 22. In one possible embodiment the outer shell 12 is a first color and the three dimensional image element 18 is a second, contrasting color. In one particularly useful embodiment the outer shell is white or other relatively light color while the three dimensional image element 18 is a darker, contrasting color. Where the three dimensional image element 18 includes a logo 30 provided on a background sheet 32, the three dimensional image element may be provided in a first color, the background sheet in a second color and the outer shell in a third color. In one possible embodiment all three colors are different in order to contrast and set forth a particular image outline 22. In another possible embodiment the second and third colors of the background sheet 32 and outer shell 12 are one color while the first color of the image element 18 is different. Often, the image element 18 is provided in a darker color which in some embodiments has a tendency to show through the lighter, covering color of the outer shell 12 thereby enhancing the 3D or holographic effect provided to the image outline 22. In yet another possible embodiment the first and third colors of the image element 18 and outer shell 12 are the same while the color of the front face 20 of the pad 16 is different.

Figure 5:
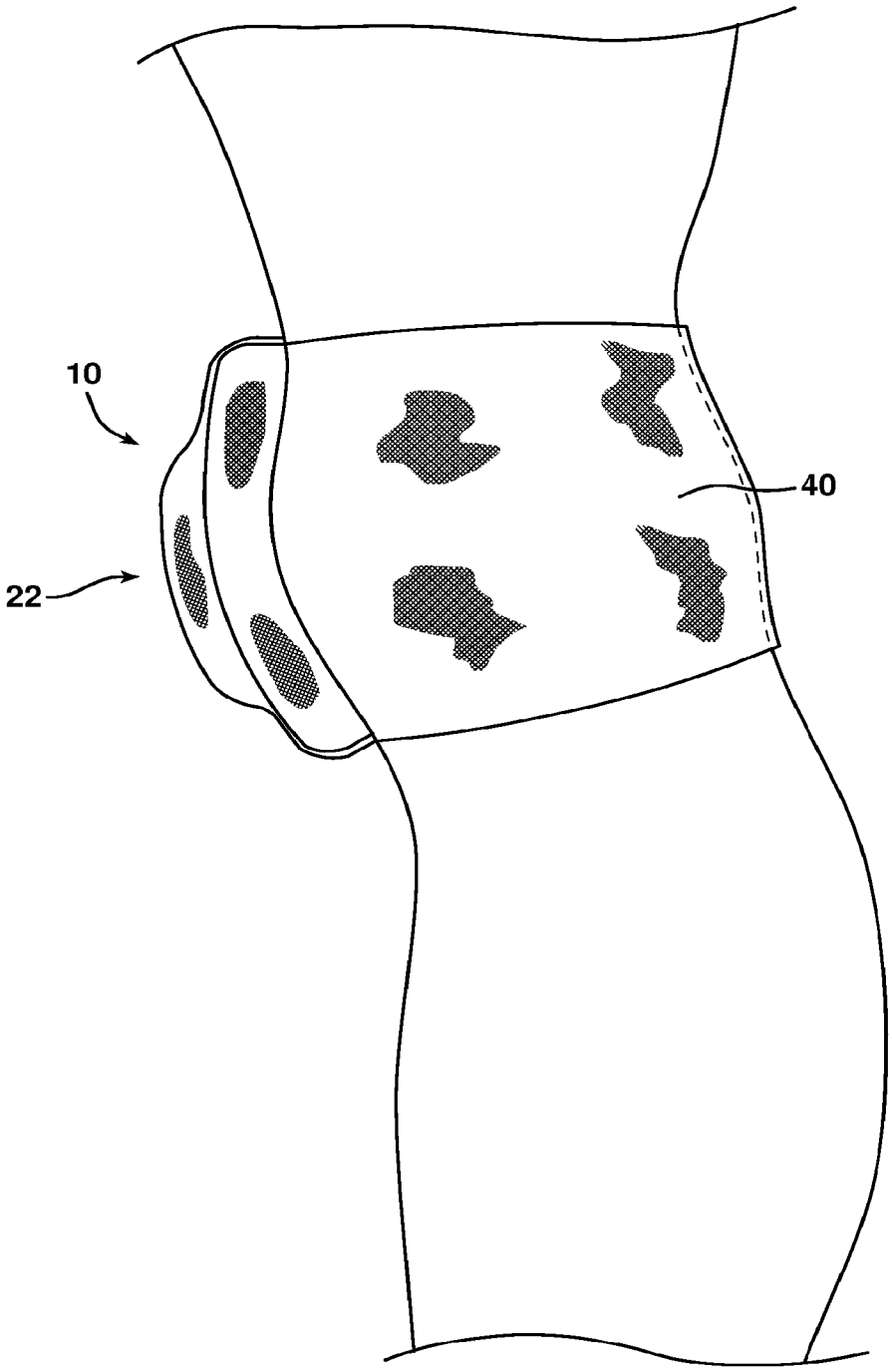
FIG. 5 is a perspective view of the sports pad secured to a knee of an individual.
Figure 6:
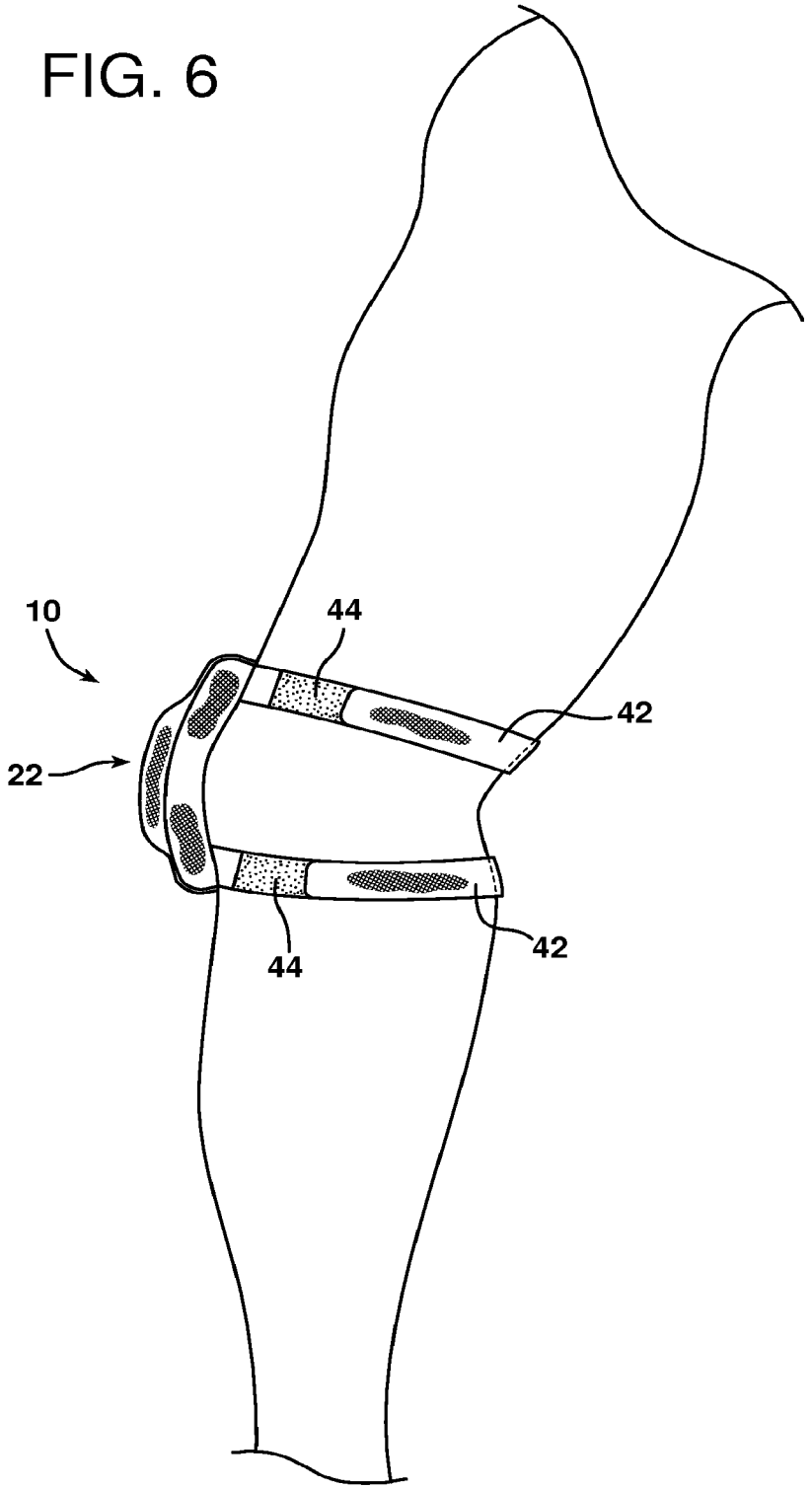
FIG. 6 is a perspective view of the sports pad secured to an elbow of an individual.

As best illustrated in FIGS. 1, 5 and 6, the sports pad 10 further includes a fastener for securing the pad 10 to a limb of an individual. As illustrated in FIG. 1, that fastener 40 comprises a partial or full elastic sleeve. Where the pad 10 is configured, sized or molded to a shape to protect and be worn over a knee, an individual inserts his foot through the fastening sleeve 40 and pulls the pad up in position so that the pad 10 with the 3D image 18 overlies the front of the knee with the elastic sleeve 40 securing the pad in position by wrapping around the back of the knee (see FIG. 5).

In an alternative embodiment the fastener 40 comprises one or more straps 42 with cooperating hook and loop fasteners 44. Where the pad 10 is configured to protect and be worn over an elbow, the pad 16 is positioned over the elbow and the straps 42 are secured with the hook and loop fasteners 44 over the arm on opposite sides of the elbow to hold the straps 42 and sports pad 10 in position with the image outline 22 projecting outwardly from the elbow.

In accordance with an additional aspect, a method of promoting a sports team is provided. That method includes equipping a player on the sports team with a sports pad 10 that includes the three dimensional image element 18 that projects an image outline 22 of a logo, such as a team logo 30, in a desired manner. As indicated above, that logo 30 may be displayed by wearing the pad 10 over a knee and/or over an elbow as desired.

The foregoing has been presented for purposes of illustration and description. It is not intended to be exhaustive or to limit the embodiments to the precise form disclosed. Obvious modifications and variations are possible in light of the above teachings. For example, forearm pads and football helmet chin straps may also be provided and are consistent with the teachings presented in this document. All such modifications and variations are within the scope of the appended claims when interpreted in accordance with the breadth to which they are fairly, legally and equitably entitled.

What is claimed:

1. A knee or elbow sports pad system, comprising:

a sleeve or strap having a first side configured to face a knee or elbow of a user and a second side opposite the first side;

an outer fabric shell defining a pocket and contacting the second side of the sleeve or strap;

a pad received and held in said pocket, the pad having a back face contacting the pocket and configured to face toward the knee or elbow of the user, and a front face opposite the back face and configured to face away from the knee or elbow of the user;

a background sheet having a first side affixed to the front face of the pad by a first fastener, the first fastener having the same shape and surface area as the background sheet, and the first side of the background sheet having a smaller surface area than the front face of the pad; and a three dimensional image element having a first surface attached to a second side of the background sheet by a second fastener, the second fastener having the same shape and surface area as the first surface of the three dimensional image element, and the first surface of the three dimensional image element having a smaller surface area then the second side of the background sheet, wherein the three dimensional image element contacts an inner face of the outer fabric shell such that an outer face of the outer fabric shell provides an image outline of the three dimensional image element, and wherein the image outline is a letter, entwined letters, a word, a number, a name, or a mascot.

2. The knee or elbow sports pad system of claim 1, wherein said outer fabric shell is a first color and said three dimensional image element is a second color.

3. The knee or elbow sports pad system of claim 1, wherein said three dimensional image element is a first color, said background sheet is a second color and said outer fabric shell is a third color.

4. The knee or elbow sports pad system of claim 1, wherein said three dimensional image element and said front face are the same color.

5. The knee or elbow sports pad system of claim 1, wherein the background sheet has a uniform thickness.

6. The knee or elbow sports pad system of claim 1, wherein the three dimensional image element is tapered outwardly from a central area toward an outer edge so that said central area projects a greater distance from the front face than the outer edge.

7. The knee or elbow sports pad system of claim 1, wherein the back face of the pad has a smaller surface area than the front face of the pad.

8. The knee or elbow sports pad system of claim 1, wherein the three dimensional image element is formed of a material selected from the group consisting of a foam, high density synthetic material, foam rubber, an plastic.

9. The knee or elbow sports pad system of claim 8, wherein the foam is polyethylene foam, polypropylene foam or polyvinyl chloride foam.

10. The knee or elbow sports pad system of claim 1, wherein the sleeve is an elastic sleeve.

11. The knee or elbow sports pad system of claim 1, wherein the strap includes hook and loop fasteners.

12. The knee or elbow sports pad system of claim 1, wherein the first fastener comprises an adhesive.

13. The knee or elbow sports pad system of claim 1, wherein the first fastener comprises Velcro™.

14. The knee or elbow sports pad system of claim 1, wherein the second fastener comprises an adhesive.

15. The knee or elbow sports pad system of claim 1, wherein the second fastener comprises Velcro™.

16. The knee or elbow sports pad system of claim 1, wherein the image outline is entwined letters.

17. The knee or elbow sports pad system of claim 1, wherein the image outline is a number.

18. The knee or elbow sports pad system of claim 1, wherein the image outline is a mascot.

19. The knee or elbow sports pad system of claim 1, wherein the image outline is a word.

20. The knee or elbow sports pad system of claim 1, wherein the image outline is a letter.

* * * * *